United States Patent [19]

Jackson

[11] 3,980,474

[45] Sept. 14, 1976

[54] METHOD OF ION IMAGING WITH ADDITIONAL CONTROL FIELDS

[75] Inventor: Jerome E. Jackson, Shaker Heights, Ohio

[73] Assignee: Addressograph Multigraph Corporation, Cleveland, Ohio

[22] Filed: Oct. 16, 1974

[21] Appl. No.: 515,172

[52] U.S. Cl. ..... 96/1 R; 346/74 ES; 346/74 J

[51] Int. Cl.[2] ..... G03G 13/22

[58] Field of Search ..... 96/1 R, 1 TE; 346/74 ES, 74 J

[56] References Cited

UNITED STATES PATENTS

| | | | |
|---|---|---|---|
| 3,645,614 | 2/1972 | McFarlane | 96/1 R |
| 3,680,954 | 8/1972 | Frank | 96/1 R |
| 3,694,200 | 9/1972 | Pressman | 96/1 R |
| 3,761,173 | 9/1973 | Fotland et al. | 96/1 R |
| 3,881,921 | 5/1975 | Frank | 96/1 R |

*Primary Examiner*—Roland E. Martin, Jr.
*Assistant Examiner*—Judson R. Hightower
*Attorney, Agent, or Firm*—Michael A. Kondzella

[57] ABSTRACT

An ion modulator process capable of producing copies of high contrast and with low background utilizes a constant charge density applied in the dark to set up uniform fringing fields which block ions directed towards background (light) areas. Funneling fields are set up in image (dark) areas in opposition to the original uniform fringing fields by simultaneous imaging and ion projection decreasing the effect of such fringing fields and permitting ions to pass through the modulator in image areas.

12 Claims, 5 Drawing Figures

METHOD OF ION IMAGING WITH ADDITIONAL CONTROL FIELDS

BACKGROUND OF THE INVENTION

This invention relates to electrophotographic processes and apparatus. In one of its more particular aspects this invention relates to a multilayered ion modulator and its use in improved electrophotographic processes.

Electrophotographic reproduction techniques for making copies of graphic originals using photoconductive media are well known. Such processes generally call for applying a blanket electrostatic charge to a photoconductor in the dark and then exposing the charged photoconductor to a pattern of light and shadow created by directing electromagnetic radiation onto a graphic original. The light-struck areas of the photoconductor are discharged leaving behind a latent electrostatic image corresponding to the original. A developed image is produced by applying an electroscopic powder to the latent electrostatic image and then fixing the image or transferring and fixing onto a suitable receiving medium such as plain paper.

This technique has been extended to foraminated structures which are formed by applying a photoconductive layer to a conductive screen or similar apertured structure. Such structures function as ion modulators selectively passing a stream of ions through the apertures of the screen in a pattern corresponding to the graphic original to be reproduced.

The ion modulators which have been developed heretofore and are known in the prior art fall into several distinct clases:

The first is a simple two-layered screen or grid construction which is formed by applying a photoconductive layer onto an apertured metallic substrate as disclosed in U.S. Pat. No. 3,220,324 to Christopher Snelling. Such a structure can be used to apply to a dielectric target an electrostatic charge corresponding to a pattern of light and shadow created by electromagnetic radiation directed onto a graphic original resulting in the creation of a latent electrostatic image thereon. Some fraction of the ions creating the latent electrostatic image, however, are allowed to pass through the apertures in areas of the modulator corresponding to background areas in the original. Copies which are made from electrostatic latent images created in this manner therefore do not generally display the high contrast and low background levels desired.

A second group of photoconductive screens of various constructions has been adapted for use with charged material particles such as charged electroscopic powders. Typical of such screens are those disclosed in U.S. Pat. No. 3,694,200 to G. L. Pressman. Such structures suffer from the deficiency that charged particles accumulate in those areas of structure which attract the particles so that ultimately, it is required that the screen be cleaned to physically remove the particles in order that the screen may be reused.

The use of such screens with ions rather than charged electroscopic powders is disclosed in U.S. Pat. No. 3,645,614 to Samuel B. McFarlane, Jr., Joseph Burdige and Norman E. Alexander.

While the prior art modulators have advanced the electrophotographic art, there are disadvantages which need to be overcome in order to provide an ion modulator system which can be operated so that copies of high quality can be made.

OBJECTS

It is accordingly an object of this invention to provide improved electrophotographic apparatus and processes.

It is another object of this invention to provide improved ion modulators which are capable of being operated to produce copies of high quality.

Another object of this invention is to provide a process utilizing an ion modulator which can produce copies displaying high contrast and low background levels.

Other objects and advantages of this invention will become apparent in the course in the following detailed disclosure and description.

SUMMARY OF THE INVENTION

The ion modulator of this invention consists of a conductive screen or grid coated on one side with a photoconductive material and coated on the other side with an insulating material, which may or may not be photoconductive.

Application of a constant charge density of appropriate polarity to the side coated with insulating material sets up uniform fringing fields which block ions directed toward background (light) areas. Funneling fields set up in image (dark) areas in opposition to such fringing fields by simultaneous imaging and ion projection decrease the effect of such fringing fields. The net result is that ions projected towards the modulator are funneled through apertures in image areas and blocked from going through apertures in background areas. A suitable dielectric surface placed in the path of ions projected through the modulator thus receives a latent electrostatic image corresponding to the original being copied. Development of the latent electrostatic image by toning with an electroscopic powder and fixing, for example, by heat or pressure produces a permanent copy upon such dielectric surface. If desired the latent electrostatic image can be toned and then transferred from the dielectric surface to a suitable receiving surface such as plain paper and fixed thereon.

THE DRAWING

DESCRIPTION OF THE PREFERRED EMBODIMENTS

Figure 1:
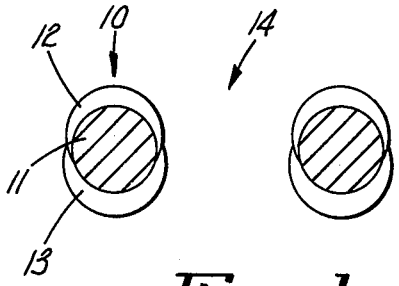
FIG. 1 is a diagrammatic cross-sectional view of one embodiment of a portion of an ion modulator according to this invention.

Referring to FIG. 1, there is shown in cross-section a diagrammatic view of an ion modulator according to one embodiment of this invention. The modulator 10 consists of conductor 11 coated on one side with photoconductor 12 and on the opposite side with insulator 13. The apertures in the ion modulator are generally indicated by the numeral 14.

Conductor 11 can be a nickel, copper, brass, aluminum or stainless steel screen which is produced by electroforming or can be a metallic grid produced by means of photochemical machining. Conductor 11 can also be any other conductive material produced by any conventional method of producing an apertured configuration, such as a wire cloth material. Conductor 11 may be any convenient size but is preferably in the range of 10–50 microns in thickness. For example, a 200 mesh wire screen in which the wire diameter is 50 microns and the average aperture size is about 74 microns in the widest dimension can be used.

Photoconductor 12 is preferably from about 3 microns to 20 microns in thickness and may be selected from a wide variety of known photoconductors including inorganic and organic materials. Selenium, zinc oxide and cadmium sulfide are representative of satisfactory inorganic materials. Various organic polymeric photoconductors such as polyvinylcarbazole, the polyvinylbenzocarbazoles described in U.S. Pat. No. 3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi are also satisfactory photoconductors. Other organic photoconductors which can be used include monomeric photoconductors which require dispersion in a suitable vehicle for example in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette all assigned to the same assignee as this invention. In many instances organic photoconductors, both polymeric and monomeric can be used with a suitable sensitizer to extend the spectral range of the photoconductor. For example, dyes can be used for this purpose. Another class of materials which are widely used are the piacids. Representative of these compounds are the oxazolone and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel, all assigned to the same assignee as this invention.

Thus any standard photoconductive composition suitable in xerographic applications can be used as a coating in fabricating the ion modulator of this invention. In order to optimize the operation thereof, however, it is essential that, in the presence of ions, the photoconductor not charge in the light. This criterion will be met if the photocurrent is the same as the incident ion flux. Such has been found to be the case where the transport of hole carriers produced by the usual light fluxes obtained in xerographic systems is sufficient to equalize the ion flux. Another requirement of the photoconductor is that it be free of deep traps so that the hole carriers are not immobilized. Both requirements have been found to be met by the use of pure selenium in the positive charging mode, which therefore constitutes a preferred embodiment of this invention.

Any insulating material, organic or inorganic, can be used as insulator 13. Polymeric insulating compositions such as a vinyl resin, for example, polystyrene, a polypropylene or an acrylic resin; a polyester, such as a polycarbonate or polyterephthalate; an epoxy resin or a silicone are suitable. Inorganic insulating materials which can be used for this purpose include silicon dioxide, silicon nitride and boron nitride. Insulator 13 can be deposited upon conductor 11 by means of any suitable coating technique, such as by sputtering an inorganic insulating material upon the surface of the conductive substrate or spraying thereon a suitable organic polymer and can be applied to provide a thickness of about from 2 microns to 20 microns.

Insulators which have low charge decay rates are preferred. The insulator should also be inert to degradation caused by corona discharge. Polystyrene, polyesters and polydiphenylsiloxanes have been found to meet these requirements and are accordingly preferred.

Either the photoconductor or the insulator can be applied to the screen first as desired.

Figure 2:
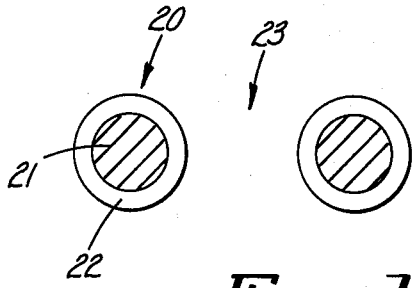
FIG. 2 is a diagrammatic cross-sectional view of another embodiment.

If desired, a photoconductor can be used as the sole coating of the conductor in order to simplify the coating operation. This embodiment is illustrated in FIG. 2 wherein modulator 20 consists of conductor 21 coated on all sides with photoconductor 22. Apertures in the ion modulator are generally indicated by the numeral 23.

Figure 3:
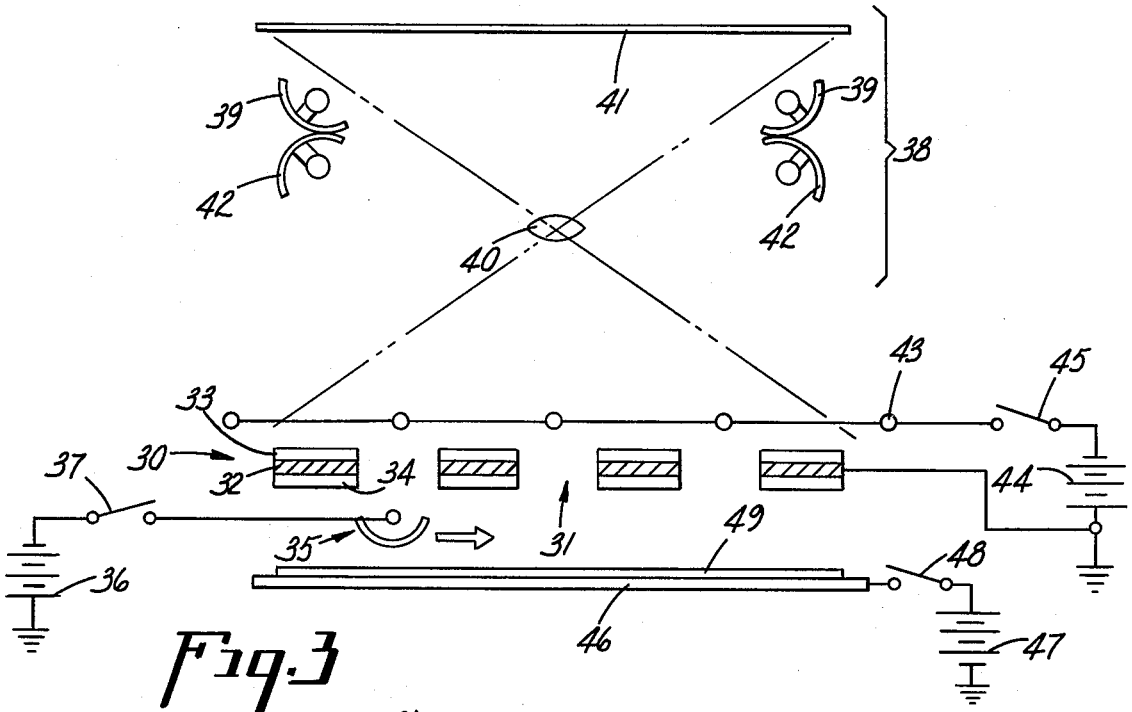
FIG. 3 is a diagrammatic view partly in cross-section of an apparatus suitable for use in this invention.

Referring to FIG. 3, there is shown an apparatus suitable for use in carrying out the process steps of the invention. Modulator 30, only a portion of which is shown, having apertures 31 consists of conductor 32, photoconductive layer 33 and insulating layer 34. Conductor 32 is connected to ground potential. Precharge corona 35 faces insulating layer 34 of modulator 30 and is connected to negative potential source 36 by means of switch 37. Corona 35 is adapted to traverse the modulator area in order to impart an electrostatic charge to insulating layer 34. Imaging system 38 consists of lamps 39 and lens 40 adapted to project a pattern of light and shadow corresponding to background and image areas of original 41 upon modulator 30. Flood lamps 42 are arranged to flood modulator 30 with light. Projection corona 43 is connected to negative potential source 44 by means of switch 45. Corona 43 is a transparent corona so as not to interfere with imaging of original 41 upon modulator 30. Collecting electrode 46 is connected to positive potential source 47 by means of switch 48 and attracts negative ions projected through apertures 31 of modulator 30. Dielectric 49 is placed adjacent collecting electrode 46 serving as a receiving surface for ions projected through modulator 30. A latent electrostatic image corresponding to original 41 is thereby created upon the surface of dielectric 49.

Figure 4:
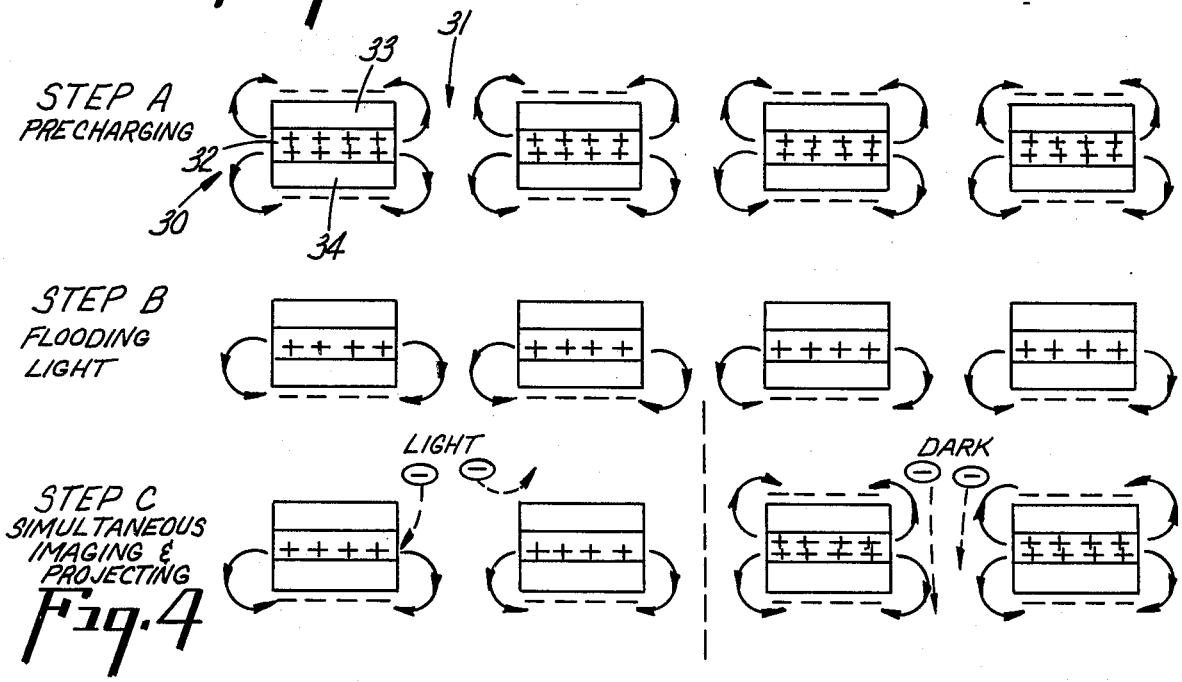
FIG. 4 is a diagrammatic view of the steps involved in one process for producing a latent electrostatic image using the ion modulator of this invention.

FIG. 4 shows the steps involved in one process using the ion modulator of this invention to produce a latent electrostatic image upon a dielectric surface. The explanation of the process will be made with reference to the apparatus shown in FIG. 3.

At the start of the process, switches 37, 45 and 48 are open as shown in FIG. 3. To begin the process switch 37 is closed connecting precharging corona 35 to a source of negative potential 36 which may be on the order of about from 5,000 volts to 8,000 volts. As corona 35 is energized, it is caused to traverse modulator 30 and to charge insulating layer 34 and photoconductive layer 33 in the dark. It should be appreciated that the charge density upon insulating layer 34 is a function of the voltage of corona 35, its rate of traversal and the composition and thickness of insulating layer 34 and that any fixed charge density desired can be arrived at by appropriate choice of these variables. The resulting charge distribution and electric fields are shown schematically in Step A of FIG. 4. The fact that charge resides on photoconductor 33, as well as on insulator 34 even though photoconductor 33 does not face precharging corona 35, the source of the negative ions which cause the charge development, is due to the generation of electrostatic field lines by the charge deposited upon insulator 34. These fields will build up and eventually cause the incoming ions to be deflected from insulator 34 and to be deposited upon the surface of photoconductor 33. This is because the magnitude of the fringing fields established as a result of charge build-up on the surface of insulator 34 approaches the magnitude of the propelling fields established by the corona wire generating and propelling ions towards the modulator. The dynamics of the ion motion around the modulator is difficult to illustrate. However, the general result can be described as continued deposition of charge uniformly around the modulator until some region of the dielectric coating, either photoconductor or insulator reaches an internal breakdown field value which leads to high leakage currents. Thin sections of the coatings such as occur in practice at the sides of the apertures are particularly susceptible to such breakdown. After the generation of these leakage currents, incoming ions are neutralized at these regions and the charge distribution remains constant. At this point precharging corona 35 is de-energized.

An alternative method of charging or sensitizing the modulator which leads to nearly the same charge distribution as shown in Step A of FIG. 4 is to energize the corona facing the photoconductor 33, that is, corona 43 in the dark. Charge would then reach the surface of insulator 34 in the manner described above.

In Step B switch 37 is opened disconnecting precharging corona 35. At the same time modulator 30 is flooded with light by energizing flood lamps 42. Photoconductor 33 is thereby discharged resulting in the charge distribution shown in Step B.

In Step C, flood lamps 42 are de-energized, switches 45 and 48 are closed and lamps 39 are turned on. Switch 45 connects projection corona 43 to a source of negative potential 44 which may be on the order of about from 5,000 volts to 8,000 volts. Switch 48 connects collector electrode 46 to a source of positive potential 47 which may be on the order of about from 2,000 volts to 6,000 volts, depending upon the spacing of the collector and the modulator. When lamps 39 are turned on, an image corresponding to original 41 is focused upon modulator 30.

Negative ions are projected from projection corona 43 resulting in the charge distribution and electrostatic fields shown in Step C of FIG. 4. Photoconductive layer 33 is thereby charged as shown. In areas corresponding to image areas in original 41 (dark), the photoconductor acts as an insulator and a charge is built up across photoconductive layer 33. In areas corresponding to background areas in original 41 (light) no charge is built up across photoconductive layer 33 because the photoconductor in the light displays increased conductive properties.

Thus in light areas corresponding to background areas in the original the fields around insulator 34 are just sufficient to block ions from passing through the screen. In the dark areas corresponding to image areas in the original the charge density on insulator 34 is generally less than the charge density present on the surface of photoconductor 33 assuming that the insulator and photoconductor are of the same approximate thickness.

In the light areas the electric field acts to repel negative ions as shown in FIG. 4. In the dark areas, the electric field acts to propel negative ions through apertures 31 in modulator 30. Ions projected through modulator 30 are attracted to dielectric 49 because of the positive potential on collecting electrode 46 thereby creating a latent electrostatic image upon the surface of dielectric 49. The charge density across insulating layer 34 can be controlled as above described to permit negative ions to pass through modulator 30 in areas corresponding to image areas in original 41 and to block negative ions in areas corresponding to background.

Figure 5:
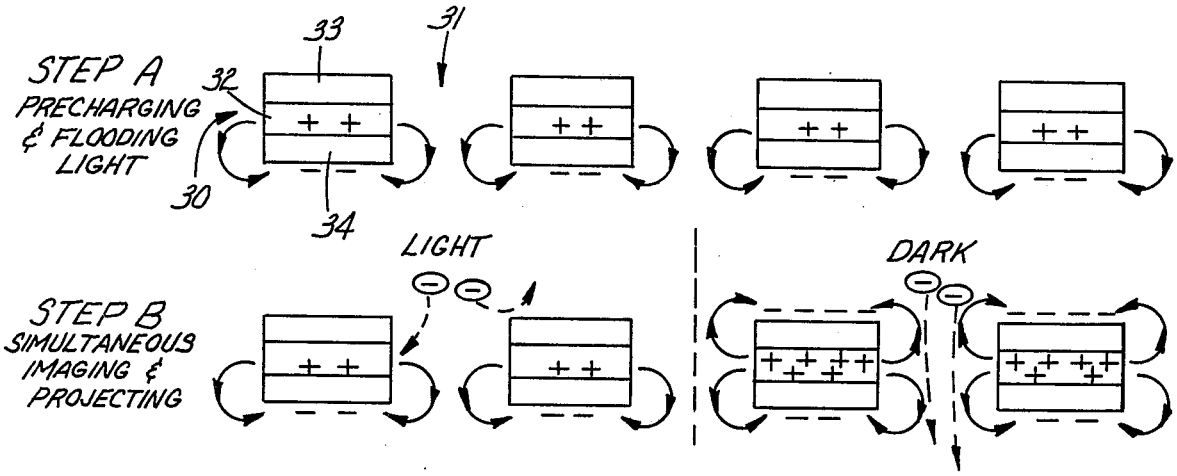
FIG. 5 is a diagrammatic view of the steps involved in another embodiment of this invention.

Another method of controlling the charging of the insulator layer of the modulator is shown in FIG. 5. In Step A the modulator is subjected to flooding illumination during precharging. In this process the illuminated photoconductor acts as a leakage path for neutralizing the corona ions resulting in a charge density on the insulator which is less than that observed in the case where charging is in the dark. The imaging step is shown in Step B of FIG. 5 and is similar to that described above.

This invention has been described with reference to specific embodiments and to various suggested conditions of operation. However, other embodiments can be utilized in order to achieve the results of the ion modulator and the electrophotographic processes of this invention. It is therefore intended that this invention is not to be limited except as defined in the following claims.

I claim:

1. A process for producing a latent electrostatic image corresponding to a graphic original upon a dielectric surface which comprises precharging substantially the entire surface of an ion modulator situated between a source of ions of a certain polarity and said dielectric surface and having a photoconductive coating thereon, uniformly illuminating the photoconductive surface of said modulator to dissipate the resulting precharge on said photoconductive surface, and projecting ions of said certain polarity from said source towards said modulator and said dielectric surface while simultaneously exposing said modulator to a pattern of light and dark areas corresponding to said original, whereby said ions are selectively passed through said modulator and deposited upon said dielectric surface to form a latent electrostatic image corresponding to said original.

2. A process according to claim 1 wherein said passage of ions through said modulator is blocked in areas corresponding to light areas in said original.

3. A process according to claim 1 wherein said modulator comprises a conductive screen coated on one side with a photoconductor and on the other side with a non-photoconductive insulator.

4. A process according to claim 1 wherein said modulator is subjected to said corona discharge on a side thereof opposite to the side facing said ion source.

5. A process according to claim 1 wherein said modulator is subjected to said corona discharge on the same side thereof as the side facing said ion source.

6. A process according to claim 1 wherein said photoconductor is an inorganic photoconductor.

7. A process according to claim 1 wherein said photoconductor is selenium.

8. A process according to claim 1 wherein said photoconductor is an organic photoconductor.

9. A process according to claim 3 wherein said insulator is a member selected from the group consisting of polystyrene, polyesters and polydiphenylsiloxanes.

10. A process according to claim 1 wherein said ions are of positive polarity.

11. A process according to claim 1 wherein said ions are of negative polarity.

12. A process according to claim 1 wherein said photoconductor is selenium and said ions are of positive polarity.

* * * * *